United States Patent [19]

Kasuya

[11] Patent Number: 4,662,738

[45] Date of Patent: May 5, 1987

[54] DENSITY DETECTING APPARATUS WHICH DETECTS IMAGE DENSITY ACCORDING TO DOCUMENT SIZE

[75] Inventor: Yukio Kasuya, Inagi, Japan

[73] Assignee: Canon Kabushiki Kaisha, Tokyo, Japan

[21] Appl. No.: 628,573

[22] Filed: Jul. 6, 1984

[30] Foreign Application Priority Data

Jul. 13, 1983 [JP] Japan ..... 58-126222

[51] Int. Cl.[4] ..... G03G 15/00

[52] U.S. Cl. ..... 355/14 R; 355/3 SH; 355/14 SH; 355/8; 271/258; 271/265

[58] Field of Search ..... 355/8, 14 E, 68, 14 R, 355/48-51, 11, 3 R, 3 SH, 14 SH; 250/205, 557, 559; 271/258, 259, 265

[56] References Cited

U.S. PATENT DOCUMENTS 4,124,295 11/1978 Gardiner ..... 355/68
4,239,374 12/1980 Tatsumi et al. ..... 355/14 E
4,352,553 10/1982 Hirahara ..... 355/14 E

*Primary Examiner*—R. L. Moses
*Attorney, Agent, or Firm*—Fitzpatrick, Cella, Harper & Scinto

[57] ABSTRACT

An image processing apparatus for a copying machine with an ADF, a facsimile or a printer, has a platen for placing originals or documents thereon, an optical system for scanning the original image, an AE measurement circuit for measuring the intensity over the entire surface of the original, a document convey mechanism for feeding/ejecting the original to and from the exposure position, and a control section including a micro computer for controlling the operation sequence. An image of optimal intensity can be reproduced for any type of original including an original having both light and dark portions.

11 Claims, 15 Drawing Figures

| | CODE | COPIER | ADF |
|---|---|---|---|
| (a) | COPY START | ← | |
| (b) | ADF START | → | |
| (c) | ORIGINAL DENSITY | ← | |
| (d) | AE MEASUREMENT | ← | |
| (e) | AE RESET | ← | |

| | $DB_0$ | $DB_1$ |
|---|---|---|
| LIGHT | 0 | 0 |
| | 1 | 0 |
| | 0 | 1 |
| DARK | 1 | 1 |

DENSITY DETECTING APPARATUS WHICH DETECTS IMAGE DENSITY ACCORDING TO DOCUMENT SIZE

BACKGROUND OF THE INVENTION

1. Field of the Invention

The present invention relates to an image processing apparatus capable of controlling the density of a reproduced image.

2. Description of the Prior Art

A conventional image processing apparatus is known which measures the density of an original image and reproduces an image in accordance with the measured density.

In an apparatus of this type, the optical system performs pre-scan of an original for measuring its density prior to the main scan for exposing a photosensitive drum to the original image. However, in this apparatus, the pre-scan stroke of the optical system must be adjusted in accordance with the minimum size of transfer sheets. For this reason, the entire image surface of the original cannot be pre-scanned or the main scan for exposure of the original image is delayed due to the time-consuming reciprocal movement of the optical system for pre-scan.

SUMMARY OF THE INVENTION

It is an object of the present invention to provide an image processing apparatus which is free from the problem with the conventional image processing apparatus as described above.

It is another object of the present invention to provide an image processing apparatus which can reproduce an image of optimal density irrespective of the density of an original or document image.

It is still another object of the present invention to provide an image processing apparatus which requires only a short period of time for pre-scan of image measurement.

It is still another object of the present invention to provide an improvement in an image processing apparatus with an automatic document feeder (ADF).

It is still another object of the present invention to provide an image processing apparatus which allows an ADF to perform measurement of the density of an original or document image.

It is still another object of the present invention to provide an image processing apparatus which can complete measurement of the density of an image of a next current document during ejection of the current document or during conveyance of the next document in an ADF.

It is still another object of the present invention to provide an image processing apparatus which measures the density over the entire surface of a document.

BRIEF DESCRIPTION OF THE DRAWINGS

FIG. 6-B is a representation showing a sample of an original;

FIG. 7-1 is a block diagram showing a CPU for performing the copying sequence and the ADF operation;

FIG. 7-2 is a timing chart showing signals associated with the control of copying sequence;

FIG. 11-B is a diagram for explaining the relationship between the original illumination lamp on the entrance sensor.

DETAILED DESCRIPTION OF THE PREFERRED EMBODIMENTS

The preferred embodiment of the present invention will now be described with reference to the accompanying drawings.

Figure 1:
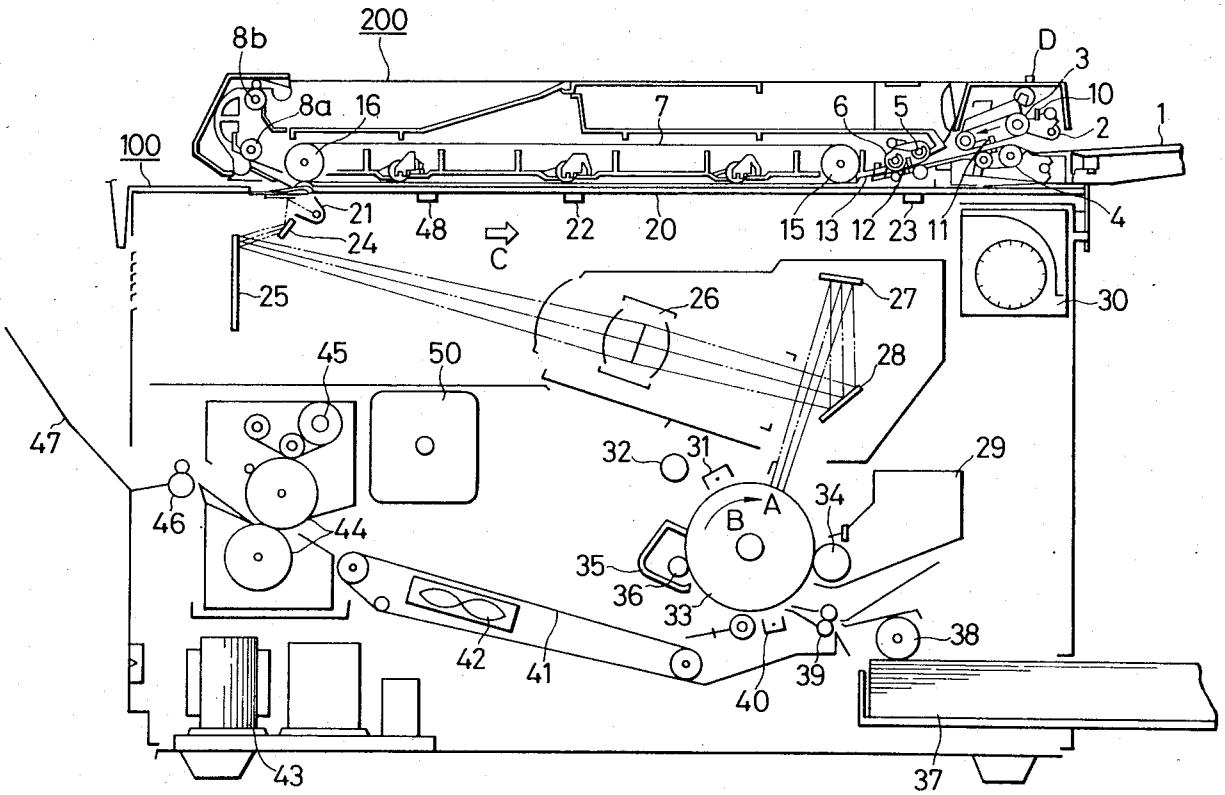
FIG. 1 is a diagramatic ilustration of the main part of an image processing apparatus according to an embodiment of the present invention.
Figures 2, 3, 4:
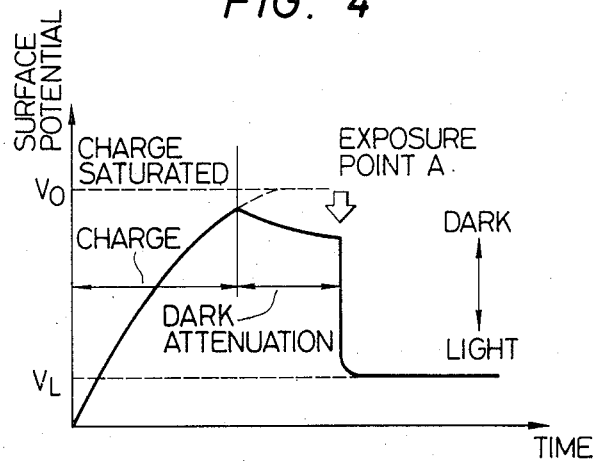
FIG. 2 is a table showing signals exchanged between a copying machine and an ADF.
FIG. 3 is a table of digital signals obtained in accordance with the varying density of the document.
FIG. 4 is a graph showing the surface potential of a photosensitive drum as a function of time.

FIG. 1 is a diagrammatic illustration of a copying machine according to an image processing apparatus according to an embodiment of the present invention. An external additional device (in this case, an ADF for automatically feeding documents) 200 is connected to a copying machine 100. The copying machine 100 and the ADF 200 are coupled to each other by means of the signals shown in FIG. 2. A copy start signal shown in FIG. 2(*a*) is generated when an original or document is set in the ADF. An ADF start signal shown in FIG. 2(*b*) is generated when the copying machine 100 is operative. The ADF start signal is not set before wait-up after the main switch is pushed, or when there is no more sheet in a paper cassette. An original density signal shown in FIG. 2(*c*) represents the density of an original (to be referred to as AE hereinafter) which is measured by the ADF 200. The original density signal can be an analog signal or a digital signal which is obtained by A/D conversion of the analog signal, as will be described in detail. Referring to FIG. 3, each of four density levels (00, 10, 01, 11) is represented by a 2-bit signal consisting of bits DB0 and DB1. It is to be noted that the number of density levels or gray levels can be increased if the bit number of the original density signal is increased. An AE measurement signal shown in FIG. 2(*d*) represents a measurement interval of an AE sensor in the ADF 200. An AE reset signal shown in FIG. 2(*e*) is for resetting the capacitor charge in the AE measurement circuit shown in FIG. 6-A.

Referring to FIG. 1, a photosensitive drum 33 rotates in a direction indicated by arrow B. A main motor 50 drives through chains the drum 33, a fixing unit 44, a conveyor 41, a pickup roller 38, an original illumination lamp 21 and the like. A high-voltage charger 31 charges the photosensitive drum 33 so as to form an electrostatic latent image at exposure point A. After the image is formed, toner is attached to the image by a developing roller 34 of a developing unit 29 to visualize the image. The obtained toner image is transferred onto a transfer sheet by a transfer charger 40. Before the image on the drum 33 is transferred onto the transfer sheet, the transfer sheet is picked up from a cassette 37 by the pickup roller 38 and is conveyed by a resist roller 39 so that the front end (leading end) of the toner image is registered or aligned with the front end of the transfer sheet. During this operation, the original is illuminated with light from the original illumination lamp 21. The optical system including the lamp 21 scans the original in a direction indicated by arrow C and forms the latent image at the point A on the drum 33 through reflecting mirrors 24, 25, 27 and 28 and a lens 26. When a resist sensor 48 supplies a signal to the resist roller 39, the resist roller 39 starts rotating to convey the transfer sheet such that the front end of the image coincides with that of the transfer sheet. Inversion sensors 22 and 23 supply signals to the main motor 50 to invert the scanning direction of the optical system. The inversion sensor 22 corresponds to the optical system inversion position when the cassette 37 is of small size (e.g., B5, A4). The inversion sensor 23 corresponds to the optical system inversion position when the cassette 37 is of large size (e.g., B4, A3).

The photosensitive drum 33 from which the image is transferred onto the transfer sheet is cleaned with a cleaner brush 36 at a cleaning unit 35 and is electrostatically cleaned with an eraser lamp 32. Thereafter, the drum 33 is ready from the next charging or image forming operation.

Meanwhile, the transfer sheet onto which the toner image is transferred is separated from the photosensitive drum 33 and is conveyed toward the fixing unit 44 by the conveyor 41. During this convey operation, the sheet is drawn downward by suction by a suction fan 42 such that the sheet may not be inadvertently removed from the conveyor 41. The image on the sheet is fixed by the fixing unit 44, and the sheet having the fixed image thereon is ejected onto a paper ejection tray 47 by a paper ejection roller 46. A web motor 45 hoists a web for cleaning the fixing roller of the unit 44. A power supply transformer 43 is arranged on the bottom of the copying machine 100. A cooling fan 30 serves to remove heat generated by the original illumination lamp 21.

The construction and operation of the respective components of the ADF 200 will be described. When the operator places an original or originals on an original tray 1, and ADF original sensor 10 detects the placed original(s). When the ADF start switch (not shown) inside an operation/display panel D is pushed, a corresponding lamp (not shown) is turned on and a current is supplied to a pickup solenoid (1100 in FIG. 11-A) so as to move a pickup roller 2 downward. When a predetermined period of time elapses after the current supply to the pickup solenoid, and ADF motor (not shown) is driven, and the uppermost original on the tray 1 starts to be conveyed. When the front end of the original conveyed between separation belts 3 and 4 moving in the direction indicated by the arrow is detected by an ADF timing sensor 11, current supply to the pickup solenoid is stopped and the pickup roller 2 moves upward. As the original is moved from the entrance toward the center of the ADF, the front end of the original is detected by an ADF original sensor 12. Then, a current is supplied to a separation solenoid (not shown) so as to move the (lower) separation belt 4 downward. Thus, the operation of the separation belts 3 and 4 is stopped.

When the ADF original sensor 12 detects the front end of the original, a current is supplied to a press solenoid (not shown). Then, a press roller 5 is moved downward to hold the original. When a clutch (not shown) is turned on, the press roller 5, a convey roller 6, a belt drive roller 15, a turn roller 16, and original ejection rollers 8*a* and 8*b* are driven by and ADF motor. Then, the original starts to be conveyed. When the original is passed below the convey roller 6 and the front end of the original is detected by an entrance sensor 13, a counter (not shown) starts counting clock pulses generated by a clock generator (not shown) synchronous with the rotation of the ADF motor. Current supply to the press solenoid is stopped, and the press roller 5 is moved upward. The original is then conveyed into a space between an entire surface belt 7 and an original glass platen 20 and is conveyed by the entire surface belt 7. When the rear end of the original is detected by the entrance sensor 13, the next original, if any, is conveyed in a similar manner. The next original waits at the position of the ADF original sensor 12 until the current original is ejected. When the count of the clock pulses generated by the clock generator described above reaches a predetermined value, a current is supplied to a brake (not shown) so as to place the current original at a predetermined position on the platen 20. Then, a copy start signal is supplied to the copying machine 100 and the copying sequence is started. The current supply to the brake is stopped after a predetermined period of time. Thereafter, a current is supplied to the clutch again, and the original is ejected by the original ejection rollers 8*a* and 8*b*.

In general, the surface potential of the photosensitive drum has the characteristics over time as shown in FIG. 4. In other words, the drum can be charged to a saturated potential V0. As the time elapses, the surface potential is attenuated, and exposed at the exposure point A to decrease to a level VL, thereby forming a contrast between light and dark portions. The level VL changes in accordance with the density of the original. That is, the level VL decreases if the original is light and increases if the original is dark.

Figure 5:
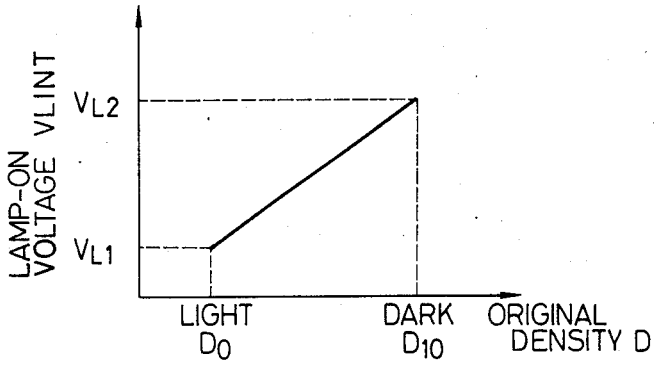
FIG. 5 is a graph showing the ON voltage of an original illumination lamp as a function of original density D.

FIG. 5 shows an ON voltage signal VLINT of the original illumination lamp 12 as a function of the original density D. It is seen from FIG. 2 that the ON voltage VLINT changes within a range of a lamp ON voltage VL1 corresponding to a light original and a lamp ON voltage VL2 corresponding to a dark original.

Figure 6A:
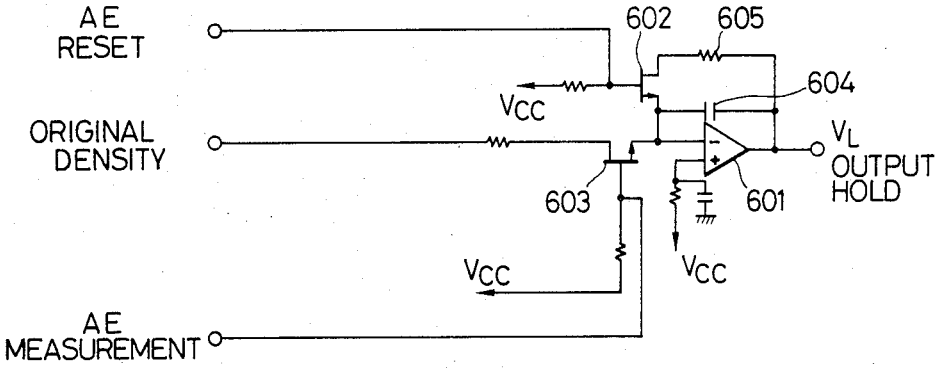
FIG. 6-A is a circuit diagram of an AE measurement circuit.
Figure 6B:
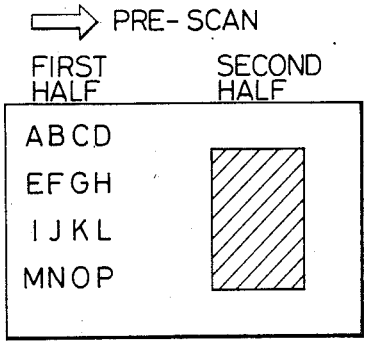

FIG. 6-A shows a circuit diagram of an AE measurement circuit 704, and FIG. 6-B shows a sample of an original.

Referring to FIG. 6-A, the AE measurement circuit has an operational amplifier 601, a peak hole capacitor 604, switching gate FETs 602 and 603 for resetting and holding, and a resistor 605 for discharging the capacitor 604.

When the original density signal supplied to the gate FET 603 reaches a predetermined level, the gate of the holding gate FET 603 is opened to hold the peak value of the original density.

Since the peak value of the original density held in this manner must be reset in the next measurement cycle, the AE reset signal in FIG. 2(e) is supplied to open the resetting gate FET 602, thereby discharging the charge on the holding capacitor 604.

FIG. 6-B shows a sample of original wherein the density of the original is different in the first and second halves thereof.

When pre-scan of the original is performed only for the first half, a dark portion such as a photograph in the second half does not correspond to the optimal exposure and the AE function cannot be obtained.

In accordance with the present invention, in order to solve this problem, when an original is supplied to or ejected from an ADF, the original is scanned over its entire surface and the density of the entire surface of the original is measured.

Figures 1, 7:
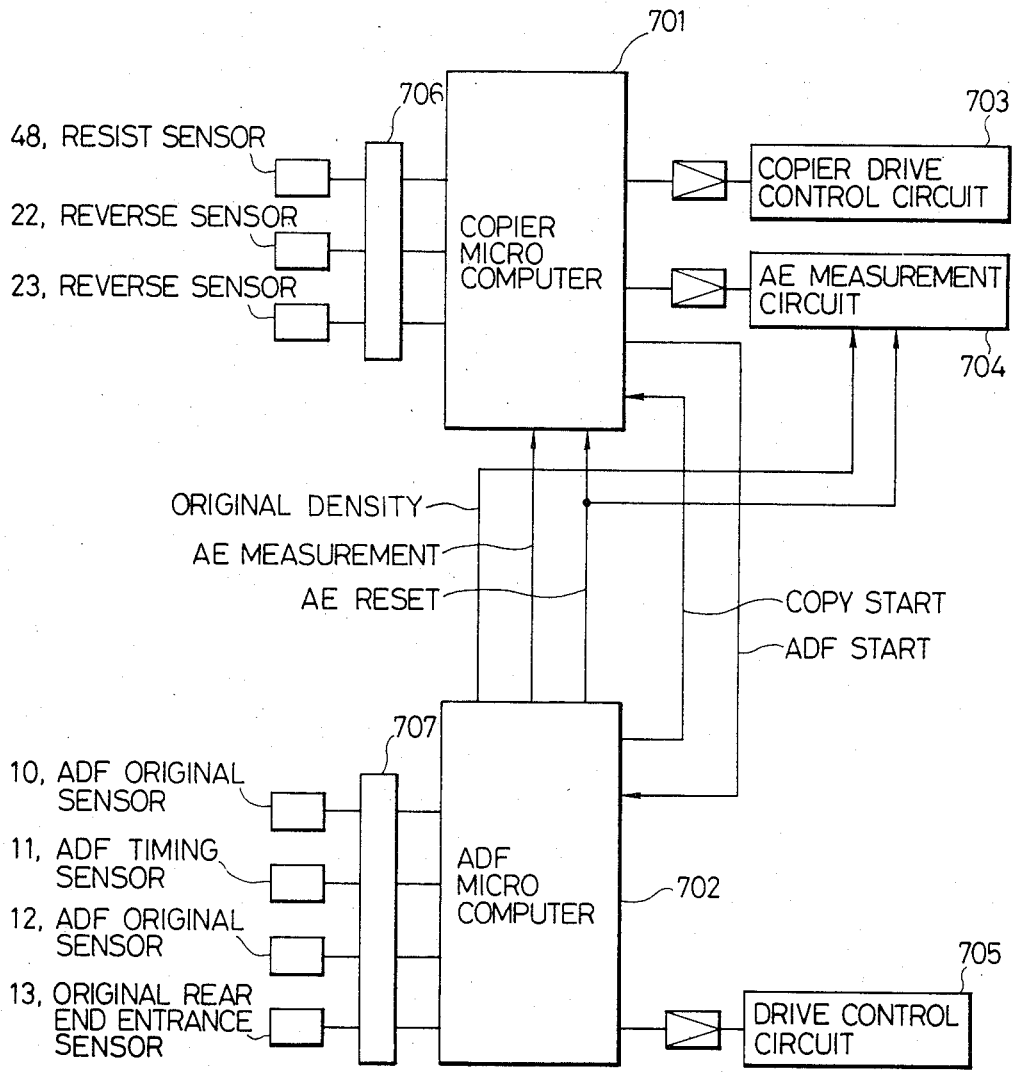
Figures 2, 7:
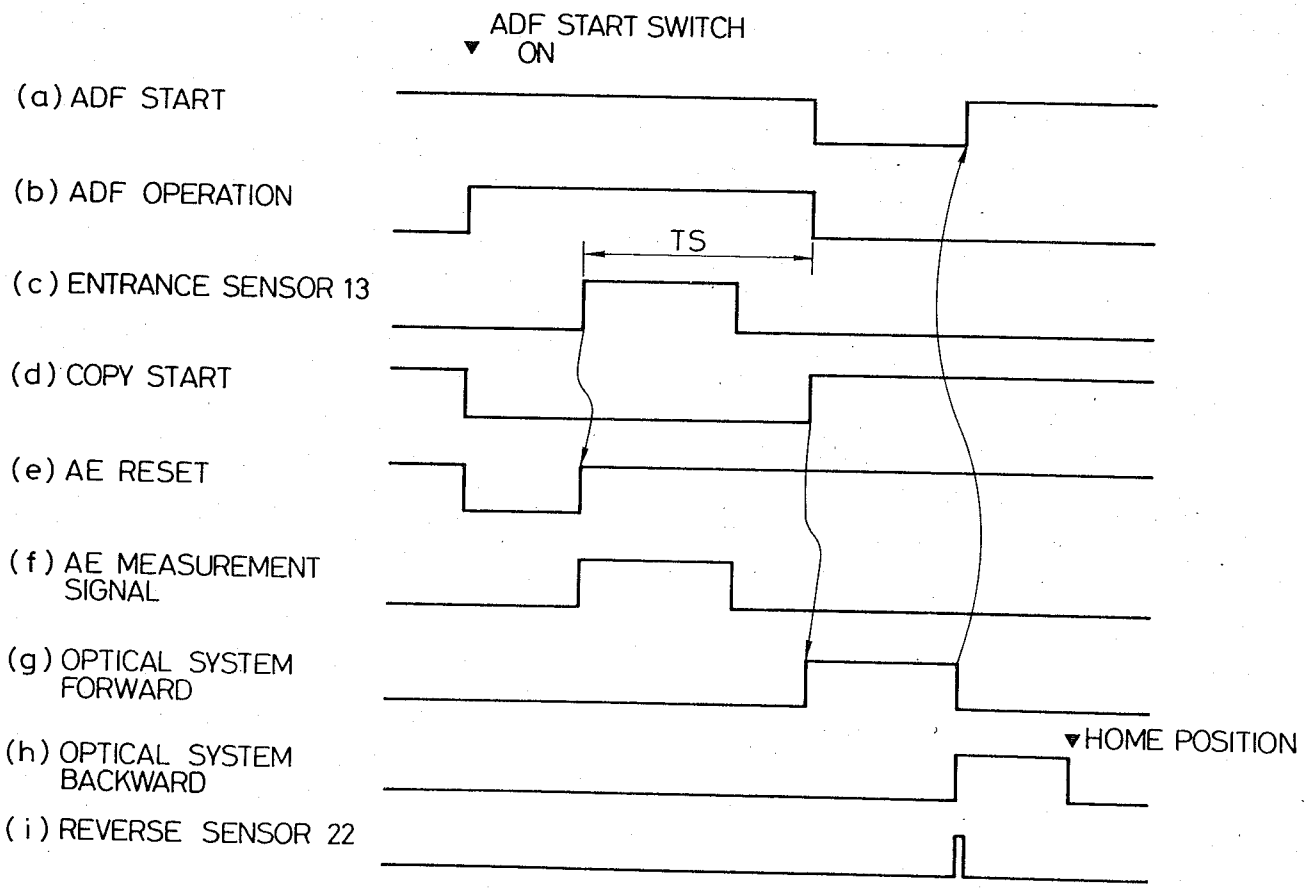

FIG. 7-1 is a block diagram of a control section for controlling the copying machine 100 and the ADF 200. A micro computer 701 controls the copying sequence, a micro computer 702 controls the ADF operation, a control circuit 703 controls the driving operation of the motor and the like of the copying machine, and AE measurement circuit 704 measures the AE, and ADF drive control circuit 705 controls the motor and the like of the ADF, and interfaces 706 and 707 serve an interfaces between the respective sensors and the micro computers. The copying sequence of the copying machine 100 and the operation of the ADF 200 will be described with reference to the timing chart shown in FIG. 7-2, the flow chart of the copying machine 100 shown in FIG. 8, and the flow chart of the ADF 200 shown in FIG. 9. The following description will be made for the operation of the ADF and the subsequent copying sequence of the copying machine 100 with reference to a case wherein a single original is to be copied using the ADF.

Figure 9A:
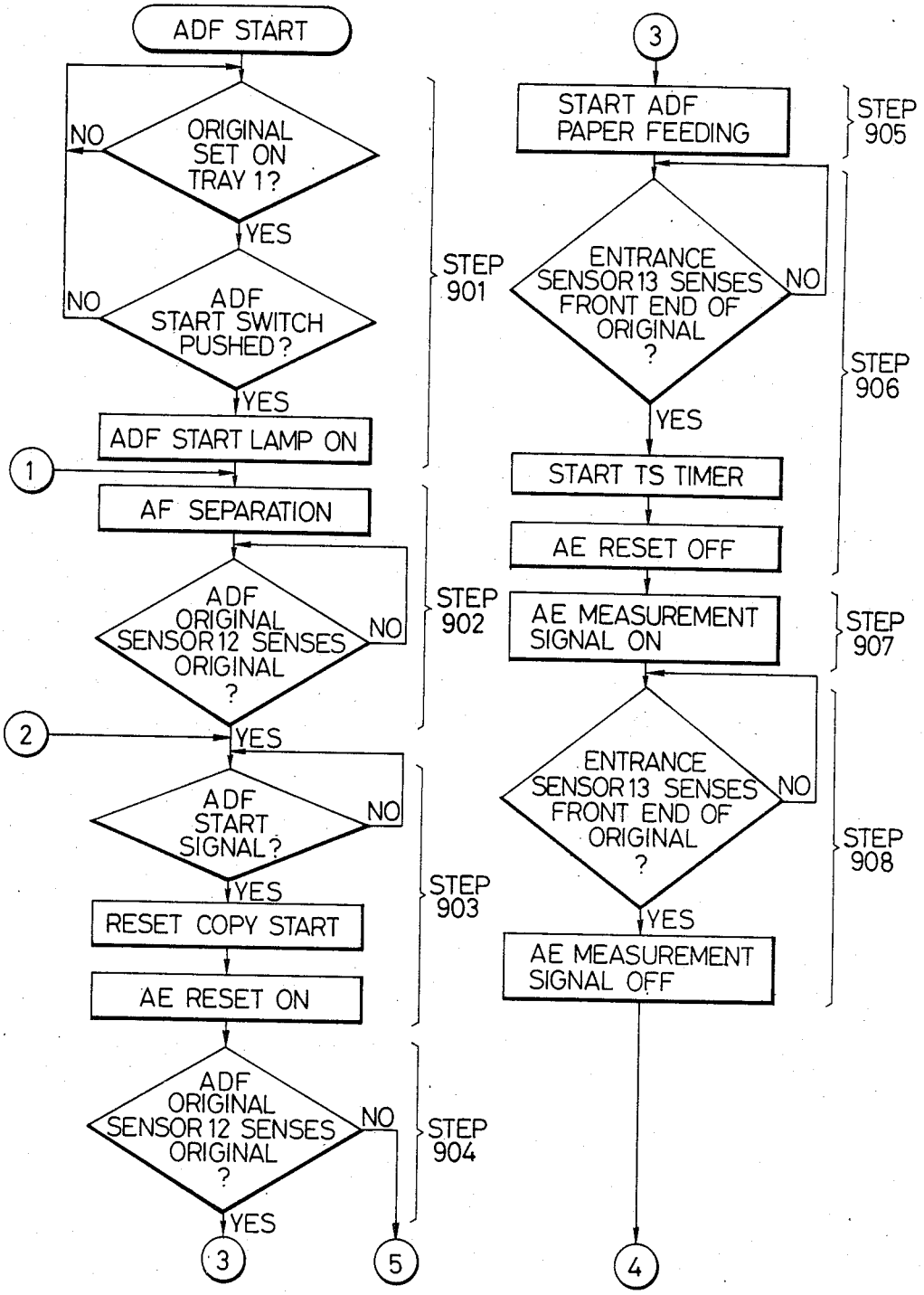
FIG. 9 composed of FIGS. 9A and 9B is a flow chart of the operation sequence of the ADF.
Figure 9B:
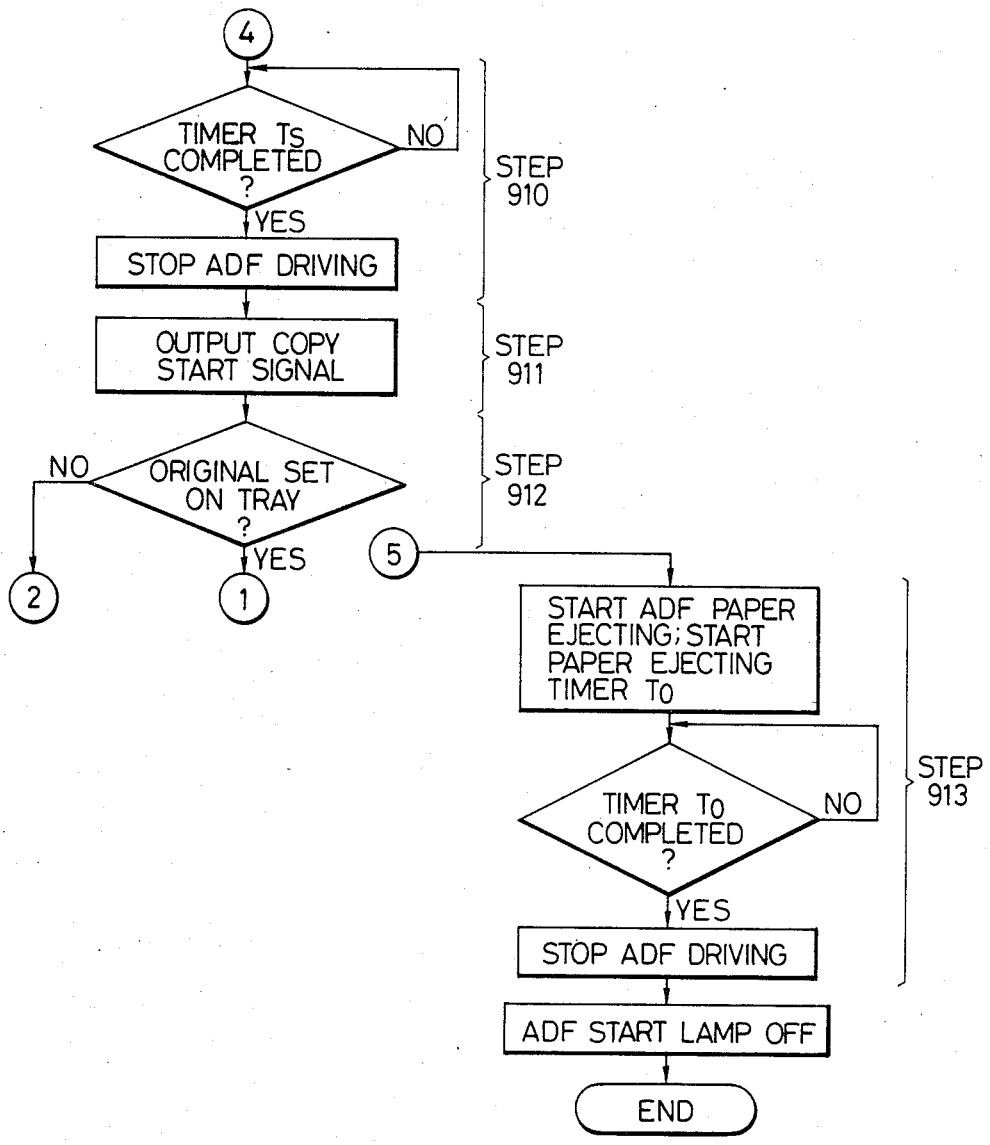

Referring to FIG. 9, in step 901, the operator sets an original or originals on the original tray 1 of the ADF, and pushes the ADF start switch at the panel D so as to turn on the ADF start switch and to energize the ADF. In step 902, the uppermost original is separated from the remaining originals. The original is supplied inside the ADF and is stopped when the front end of the original is detected by the ADF original sensor 12. In this state, if the ADF start signal is set or enabled, the copy start signal is reset so as to prohibit the copying operation of the copying machine and the AE reset signal is turned on (step 903). If it is determined in step 904 that the ADF original sensor 12 detects the original, the flow advances to step 905 to start ADF paper or original feeding. However, if it is determined in step 904 that the ADF original sensor 12 does not detect the original, the flow advances to step 913 to be described later to perform ADF paper ejection. In step 905, the drive motor and the clutch are turned on to start feeding the paper or original. In step 906, it is checked if the front end of the original is detected by the entrance sensor 13. When it is determined in step 906 that the entrance sensor 13 detects the front end of the original, an original stop counter TS is started. The timer TS counts up pulses from a clock generator (not shown).

In order to perform the AE measurement, the AE measurement circuit shown in FIG. 6-A is operated. In step 906, the AE reset signal which was turned on in step 904 is turned off so as to prepare for the AE measurement. In step 907, the AE measurement signal is turned on to enable the AE measurement circuit.

In order to perform pre-scan over the entire surface of the original, when the rear end of the original is detected by the entrance sensor 13, the AE measurement signal is turned off to complete the AE measurement in step 908. After the count of the original stop counter TS reaches a predetermined value, the drive motor and the clutch are turned off so as to stop the original at a predetermined position (exposure position) on the original glass plate 20 (step 910). The copy start signal is supplied from the ADF to the copying machine, and the copying machine starts the copying operation of a predetermined number of sheets (step 911).

It is then checked if the next original is set on the original tray 1. If there is another original waiting to be copied, the flow returns to step 902 and the ADF starts the operation. However, if there is no more original, the flow returns to step 903. When the copying operation of a predetermined number of sheets is completed and the ADF start signal is supplied from the copying machine to the ADF, the flow advances to step 904. In step 904, since the ADF original sensor 12 does not detect the original, the flow advances to step 913, as has been described above.

In step 913, in order to eject the original at the exposure position, the drive motor and the clutch are turned on so as to start a paper ejecting timer T0, thereby ejecting the original. When the preset time of the ejecting timer T0 is up, the drive motor and the clutch are turned off, the ADF start lamp is turned off, and the flow returns to the start of the sequence. When there is a next original waiting to be copied, the current original is ejected while the next original is fed and is subjected to AE measurement.

The copying sequence of the copying machine 100 will be described with reference to FIGS. 7-2 and 8. FIG. 7-2 is a timing chart for explaining the operation of the copying machine 100, and FIG. 8 is a flow chart showing the control sequence of the copying machine 100.

Figure 8:
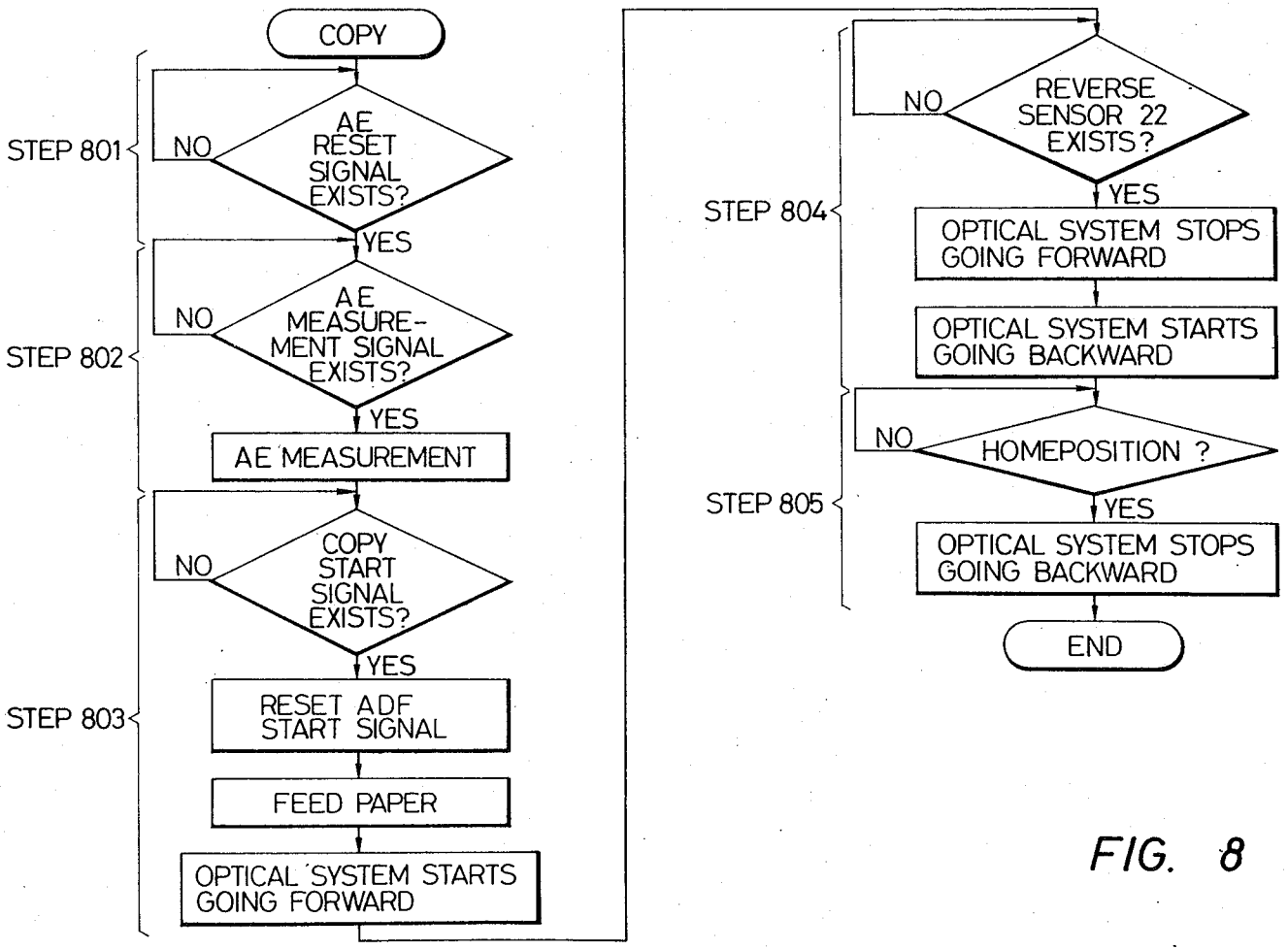
FIG. 8 is a flow chart of the copying sequence.

Referring to FIG. 8, in step 801, the ADF start signal is supplied to the ADF as an enable signal. This state corresponds to step 903 in FIG. 9. When the original or originals are set on the original tray and the copying operation can be performed, the copy start signal from the ADF is received by the copying machine as a copy enable signal, in step 911 in FIG. 9. In response to this copy start signal, the copying machine 100 starts the copying sequence. First, the ADF start signal is reset so as not to allow an erratic operation of the ADF. This signal is reset so as to prohibit the operation of the ADF until the optical system is inverted in scanning direction after the copying operation is completed. In order to prepare for the AE measurement, the AE value holding element of the AE measurement circuit must be reset. For this purpose, when it is determined in step 801 that the AE reset signal from the ADF is received, the AE measurement circuit shown in FIG. 6-A is reset.

Next, when the original is detected by the entrance sensor 13 at the side of the ADF, the AE reset signal is turned on, and the AE measurement signal for the AE measurement is turned on. This state corresponds to steps 906 and 907 in FIG. 9.

When the rear end of the original is detected by the entrance sensor 13, the AE measurement signal is turned off so as to stop the AE measurement. When the original is set at a predetermined position of the ADF, the copy start signal is set in step 803. Then, the optical system starts moving forward until it reaches the inversion sensor 22. When the optical system is detected by the inversion sensor 22 in step 804, the optical system is inverted and is moved backward. When it is determined in step 805 that the optical system has returned to the home position, the optical system is stopped and a series of copying operation steps is completed.

Figure 10:
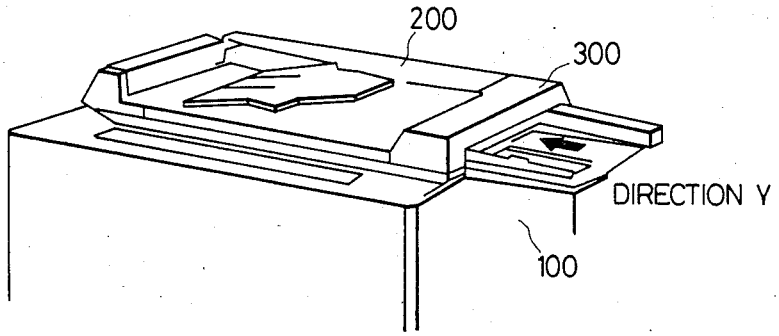
FIG. 10 is a perspective view showing the outer appearance of the upper portion of the apparatus shown in FIG. 1.
Figure 11A:
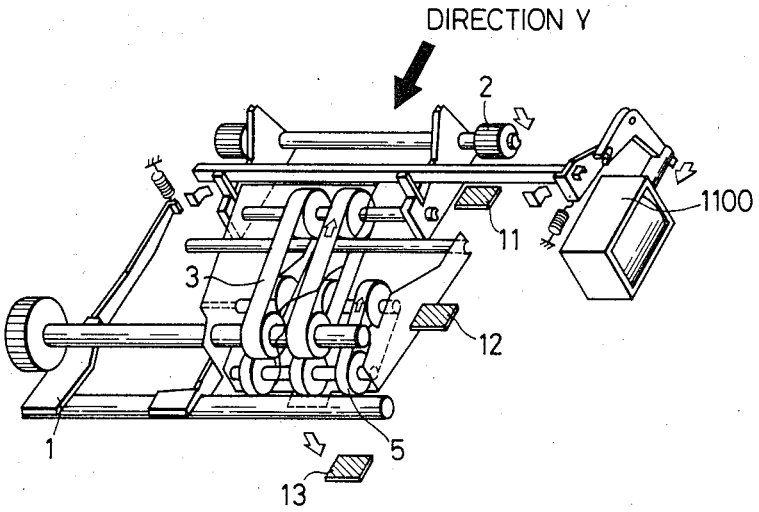
FIG. 11-A is a perspective view showing the internal structure of the apparatus shown in FIG. 10.
Figure 11B:
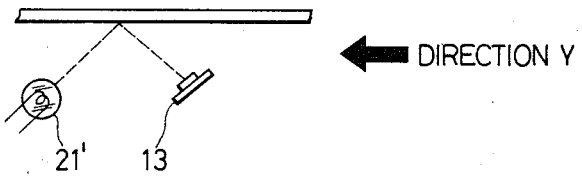

FIG. 10 is a perspective view showing the outer appearance of the upper portion of the system shown in FIG. 1 including the copying machine 100 and the ADF 200. The original is inserted in the direction indicated by arrow Y. FIG. 11-A is a perspective view showing the internal structure of a portion 300 shown in FIG. 10. As has been described above, the entrance sensor 13 illuminates the original by means of the lamp 21' as shown in FIG. 11B and reads the reflected light from the original. Since the original is being conveyed in the direction Y, the original density over its entire surface can be read.

Although the present invention was described with reference to a copying machine, the present invention can be similarly applied to a facsimile system or an apparatus which reads an original image by means of a CCD or the like for converting the read signals into electrical signals, converts the electrical signals into binary or digital signals, and transmits the obtained signals or print a corresponding image. In this case, the original density can be checked while the CCD is kept OFF, and the threshold level or quantizing level for the signal conversion can be switched in accordance with the measurement results obtained, so that the optimal image reproduction can be performed.

What I claim is:

1. A detecting apparatus comprising:

a platen for placing a document thereon;

moving means for moving the document to a predetermined position on said platen;

detection means for detecting the presence of a document being moved by said moving means; and measurement means for measuring the intensity of reflected light from the document being moved by said moving means in response to the output from said detection means.

2. An apparatus according to claim 1, wherein said moving means includes means for feeding the document to said platen and stopping the document thereon.

3. An apparatus according to claim 2, wherein said moving means includes means for mounting a plurality of documents thereon and wherein, during delivery of one document, said measurement means measures the density of the next document while said next document is being moved.

4. An apparatus according to claim 1, wherein said measurement means is reset prior to a detection of the presence of the document by said detection means.

5. An apparatus according to claim 4, wherein said measurement means is restarted upon detection of the presence of the document by said detection means.

6. An apparatus according to claim 1, wherein said detection means is provided within said moving means.

7. An apparatus according to claim 1, wherein said detection means includes reciprocally movable scanning means for exposure-scanning the document on said platen and said measurement means measures the intensity of light from the document being moved by said moving means with said scanning means stopped at a predetermined position.

8. An apparatus according to claim 1, wherein said apparatus forms a part of an image processing device and the intensity measurement is utilized in processing an image of the document.

9. A detecting apparatus comprising:

measurement means for measuring the intensity of reflected light from a document; and control means for controlling said measurement means to measure said reflected light intensity in response to the position of the document.

10. An apparatus according to claim 9, wherein said control means includes means for detecting the presence or absence of a document and controls said measurement means in response to the output from said detecting means.

11. A detecting apparatus according to claim 9, wherein said control means controls said measurement in response to the length, in the document feeding direction, of the document.

* * * * *